US006590994B2

(12) United States Patent
Tanase et al.

(10) Patent No.: US 6,590,994 B2
(45) Date of Patent: Jul. 8, 2003

(54) LINEAR VIBRATING DEVICE AND SPEAKER EQUIPPED WITH THE SAME

(75) Inventors: Rento Tanase, Hamamatsu (JP); Atsushi Yoshida, Hamamatsu (JP); Tetsu Kobayashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/920,553

(22) Filed: Aug. 1, 2001

(65) Prior Publication Data

US 2002/0021821 A1 Feb. 21, 2002

(30) Foreign Application Priority Data

Aug. 4, 2000 (JP) ..... 2000-237498
May 31, 2001 (JP) ..... 2001-164609

(51) Int. Cl.[7] ..... H04R 25/00

(52) U.S. Cl. ..... 381/431; 381/190; 381/191; 381/408

(58) Field of Search ..... 381/431, 191, 381/399, 408, 409, 190, 173

(56) References Cited

U.S. PATENT DOCUMENTS 3,997,739 A * 12/1976 Kishikawa et al.
4,242,541 A * 12/1980 Ando

* cited by examiner

*Primary Examiner*—Sinh Tran
(74) *Attorney, Agent, or Firm*—Pillsbury Winthrop LLP

(57) ABSTRACT

Speaker includes a diaphragm, and a linear vibrating device attached to a peripheral portion of the diaphragm. The linear vibrating device includes a conductor line meandering in a wave-like shape along the surface of the diaphragm, and magnets disposed in opposed relation to the conductor line. The magnets are disposed in regions surrounded by adjoining mountain portions and adjoining valley portions of the conductor line. The magnets are arranged in such a manner that every adjoining magnets have their magnetic poles of opposite polarities located close to the conductor line.

22 Claims, 9 Drawing Sheets

PRIOR ART

PRIOR ART

LINEAR VIBRATING DEVICE AND SPEAKER EQUIPPED WITH THE SAME

BACKGROUND OF THE INVENTION

The present invention relates to an improved linear vibrating device for vibrating a speaker diaphragm and a speaker equipped with such an improved linear vibrating device.

There have been known various small-sized vibrating devices suitable for use in speakers (loudspeakers) and particularly in planar speakers, as will be set forth below. In one type of planar speaker using an electrically-conductive actuator, as shown in FIG. 15, the actuator A is positioned in a center portion of a diaphragm P to drive or vibrate the diaphragm P. Because the electrically-conductive actuator A has a great weight and size, the actuator A would make it difficult to reduce the thickness of the planar speaker. In cases where a plurality of such electrically-conductive actuators are provided in the diaphragm, it is difficult to drive the individual actuators with no phase delay, and the necessary costs would greatly increase.

Small electrically-conductive actuators today used for information communications, such as telephone sounders and buzzers, can not appropriately drive the diaphragm of a planar speaker of an ordinary size, because they produce only small outputs although they are small enough in size.

Also known is a type of speaker using a piezoelectric film as a diaphragm vibrating source, which would however require high manufacturing costs. Further, the piezoelectric film would give rise to only small vibrating displacements due to its insufficient vibrating force in low frequencies.

There is known another type of planar speaker using printed coils. As schematically shown in FIGS. 16 and 17, electrically-conductive materials are printed on the diaphragm to provide a plurality of coils C. A plurality (a succession) of magnets M are positioned in opposed relation to the printed coils C, and the coils C and magnets M are enclosed by a common iron base B. The magnets M are arranged in such a manner that the different (N and S) magnetic poles thereof alternate along the longitudinal direction of the coils, and the coils C are formed in such a manner that they exhibit N and S magnetic poles alternately in correspondence with the alternate magnetic poles of the magnets. Specifically, as driving sound signals are input to the printed coils, the coils produce magnetic fields, so that attractive and repulsive forces between the coils and the magnets cause vibrations of the speaker diaphragm. However, because the diaphragm used in this type of planar speaker has a small vibrating area and has low rigidity, it can not produce sufficiently great outputs or outputs in low pitch ranges. Although the use of the printed coils on the diaphragm permits a reduction in the thickness of the planar speaker, it is necessary to wind every adjoining coils in opposite directions so as to correspond to the alternate N and S magnetic poles of the magnets, which would result in complicated wiring. Further, because this speaker yields driving force using leakage flux leaking out of the magnet fields produced between the adjoining coils and directed toward the corresponding coils, it achieves only a low driving efficiency, and the printed coils can not be positioned to overlap each other or inserted between the magnets. As a consequence, this conventional speaker can not produce great-enough outputs via the coils and magnets.

Therefore, with the speakers using the conventional diaphragm vibrating devices, it was difficult to reduce the speaker size and produce great outputs and good frequency characteristics.

SUMMARY OF THE INVENTION

In view of the foregoing, it is an object of the present invention to provide an improved speaker which is small in size and yet can produce great outputs and good frequency characteristics, as well as an improved vibrating device for use in such a speaker.

In order to accomplish the above-mentioned, the present invention provides a speaker which comprises: a diaphragm; and a linear vibrating device attached to a peripheral portion of the diaphragm for vibrating the diaphragm. The linear vibrating device includes a conductor line meandering, in a wave-like shape or configuration, along a first surface of the diaphragm, and a succession of magnets disposed in opposed relation to the conductor line. The magnets are disposed in regions surrounded by adjoining mountain portions and adjoining valley portions of the conductor line and are arranged in such a manner that the respective magnetic poles of each adjoining pair of the magnets are located close to the conductor line and have opposite (N and S) polarities.

In one embodiment, a plurality of the linear vibrating devices may be disposed along the peripheral portion of the diaphragm.

The speaker of the present invention may further comprise an auxiliary conductive line extending, in a wave-like shape, along a second surface of the diaphragm opposite to the linear vibrating device. The auxiliary conductive line corresponds in position to the conductor line of the linear vibrating device and is arranged to form magnetic poles of the same polarities as the magnetic poles of the conductor line of the linear vibrating device.

The speaker of the present invention may further comprise a succession of auxiliary magnets disposed on the other surface of the diaphragm opposite to the linear vibrating device in such a manner that the magnetic poles of the auxiliary magnets are opposed to the magnetic poles of the magnets of the linear vibrating device with the diaphragm interposed therebetween and have opposite polarities to the magnetic poles of the magnets of the linear vibrating device.

In one embodiment, a pair of the linear vibrating devices may be disposed on the opposite surfaces of the diaphragm so as to be opposed to each other with the diaphragm interposed therebetween.

The diaphragm may have a plurality of holes formed in the regions surrounded by the adjoining mountain portions and adjoining valley portions of the conductor line, and each of the holes may be formed as a through-hole or has a substance of high permeability inserted therein.

The diaphragm may have a plurality of holes formed in the regions surrounded by the adjoining mountain portions and adjoining valley portions of the conductor line, and the magnetic poles of the magnets may each be positioned within or in proximity to one of the holes. Alternatively, the speaker may further comprise a plurality of yokes each connected with one of the magnets, and the distal ends of the yokes, rather than the magnetic poles of the magnets, may each be positioned within or in proximity to one of the holes.

The conductor line may be provided on the diaphragm by plating or printing.

The speaker of the present invention may further comprise a piezoelectric vibrating device attached to the diaphragm along with the linear vibrating device.

According to another aspect of the present invention, there is provided a linear vibrating device which comprises: a conductor line meandering, in a wave-like shape, along a surface of a diaphragm; a succession of magnets disposed in opposed relation to the conductor line, the magnets being disposed in regions surrounded by adjoining mountain portions and adjoining valley portions of the conductor line and being arranged in such a manner that respective magnetic poles of each adjoining pair of the magnets are located close to the conductor line and have opposite polarities.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE PREFERRED EMBODIMENTS

Figure 1:
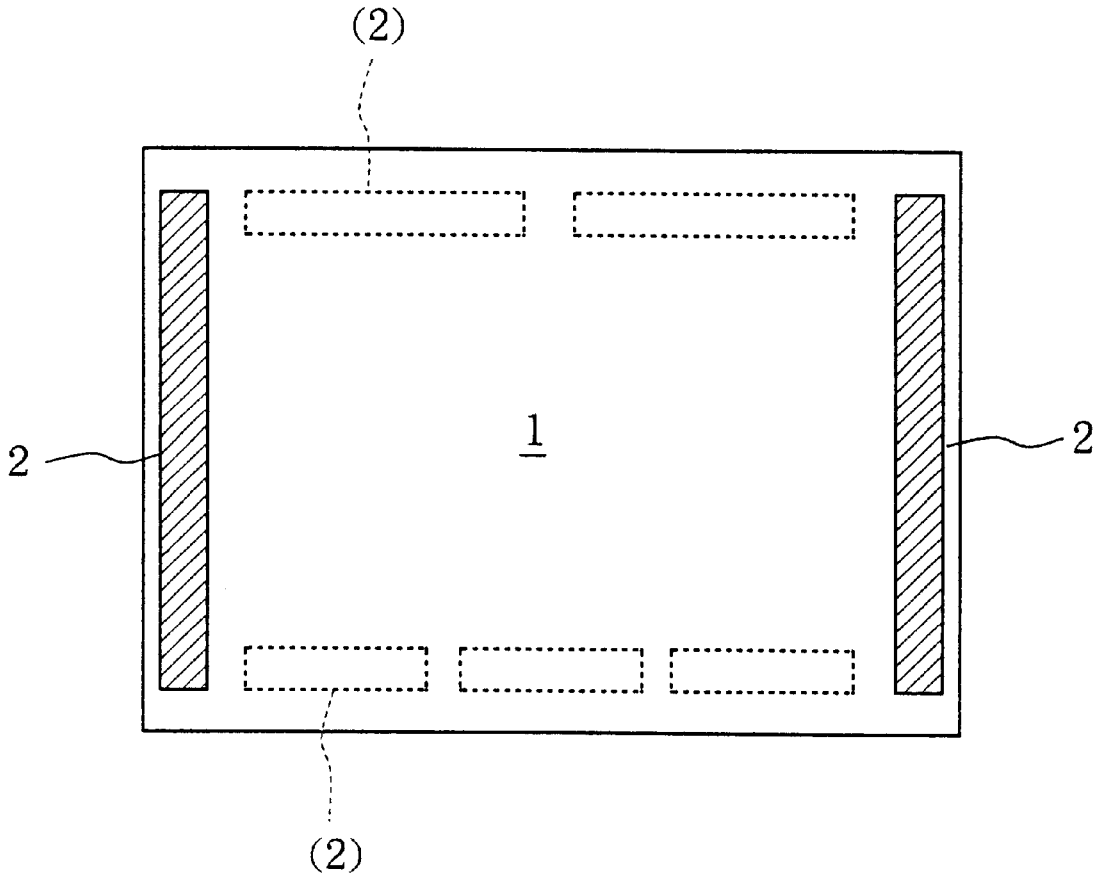
FIG. 1 is a front view of a speaker in accordance with an embodiment of the present invention.

FIG. 1 shows a speaker in accordance with an embodiment of the present invention. This speaker of the invention includes a diaphragm 1 generally in the shape of a rectangular plate, and a pair of linear vibrating devices 2 disposed on and extending vertically along opposite side edge portions of the diaphragm 1. The speaker can be supported on a desired place, for example, by securing a peripheral edge portion or portions of the diaphragm 1 via springs, soft edges, hanging lines or other suitable means.

The diaphragm 1 may be in the form of a plate having any other planar shape than a rectangle, such as a polygonal, circular or elliptic shape. Further, the diaphragm 1 may be of a spherical shape rather than the planar shape. Further, the diaphragm 1 may be made of transparent glass, plastic or the like so that pictures shown on a CRT, LCD or other display can be clearly viewed through the speaker, although the diaphragm 1 may of course be in the form of a plate made of opaque wood, metal, plastic or other material.

Figure 2:
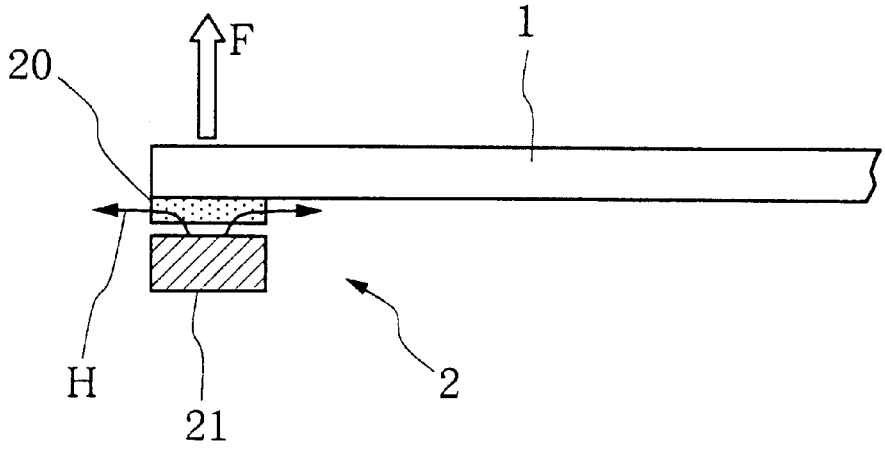
FIG. 2 is a cross-sectional view showing part of the speaker shown in FIG. 1.

As shown in a cross section view of FIG. 2, each of the linear vibrating devices 2 includes a wave-shaped conductor line 20 meandering along one surface of the diaphragm 1 in a wave-like fashion, and a plurality of (a succession of) magnets 21 disposed in opposed relation to the conductor line 20. As will be later described in detail, the magnets 21 are disposed in regions surrounded by adjoining mountain portions and adjoining valley portions of the conductor line 20 and are arranged in such a manner that the respective magnetic poles of each adjoining pair of the magnets 21 are located close to the conductor line 20 and have opposite (N and S) polarities; thus, the magnets 21 constitutes an alternate sequence of N and S magnetic pole along the conductor line 20 in proximity thereto.

Figure 3A:
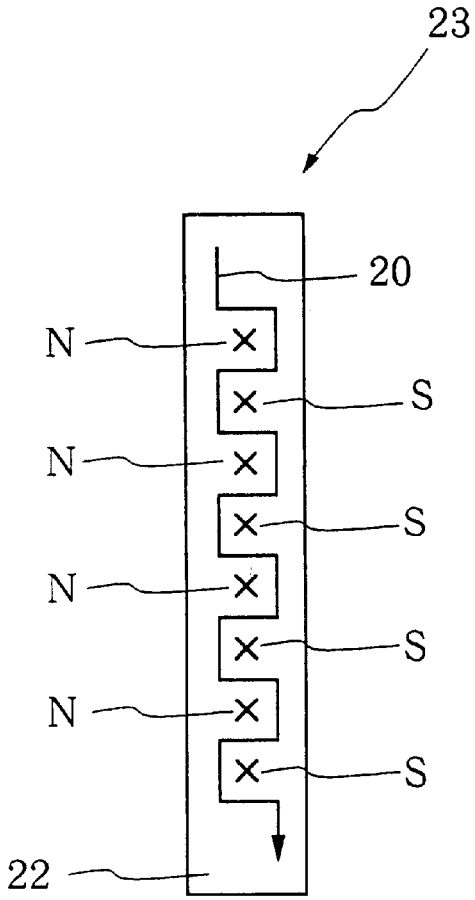
FIGS. 3A and 3B are front views showing an embodiment of a linear vibrating device employed in the speaker of FIG. 1, and particularly showing two conductor elements constituting the linear vibrating device.
Figure 3B:
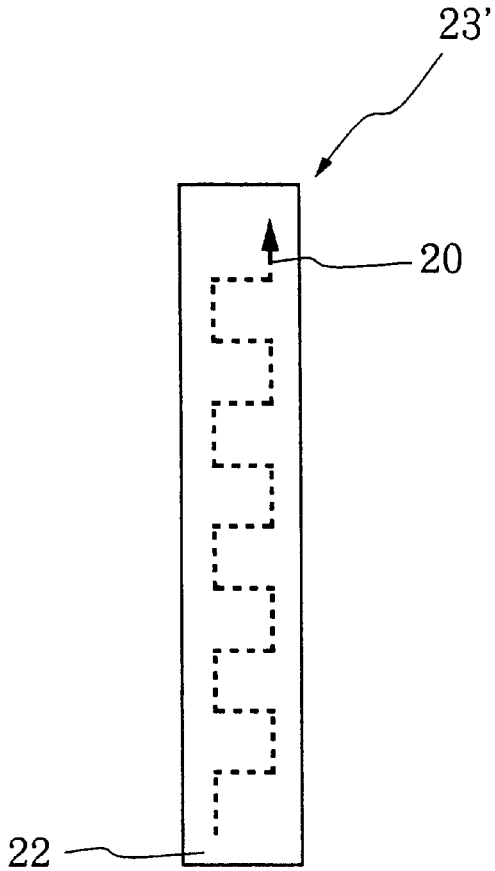

As shown in FIG. 3A, the conductor line 20 meanders on a substrate 22 to form a wave-like (in the illustrated example, rectangular-wave-like) overall shape, and the conductor line 20 and substrate 22 together constitute a conductor element 23. For convenience of description, rightward projecting portions of this wave-shaped meandering conductor line 20 will be called "mountain portions", and other portions (leftward projecting portions) of the conductor line 20 between such mountain portions will be called "valley portions". The magnets 21 are provided on or close to the surface of the substrate 22 in the regions surrounded alternately by the mountain and valley portions of the conductor line 20 as denoted by "x" marks; that is, each of the magnets 21 is surrounded by either the mountain portion or the valley portion. Further, the magnets 21 are arranged in such a manner that their N and S poles alternate along the conductor line 20, as noted earlier. FIG. 3B shows another example of the conductor element 23' where the conductor line 20 meanders in an opposite direction to the conductor line 20 of FIG. 3A. As regards the illustrated example of FIG. 3B too, rightward projecting portions of the meandering conductor line 20 will be called "mountain portions", and other portions (leftward projecting portions) of the conductor line 20 between such mountain portions will be called "valley portions". The mountain and valley portions of the conductor line 20 shown in FIG. 3B correspond in position to the valley and mountain portions of the conductor line 20 shown in FIG. 3A. In each of FIGS. 3A and 3B, an arrow at one end of the conductor line 20 represents an exemplary direction of an electric current flowing through the conductor line 20.

Figure 4:
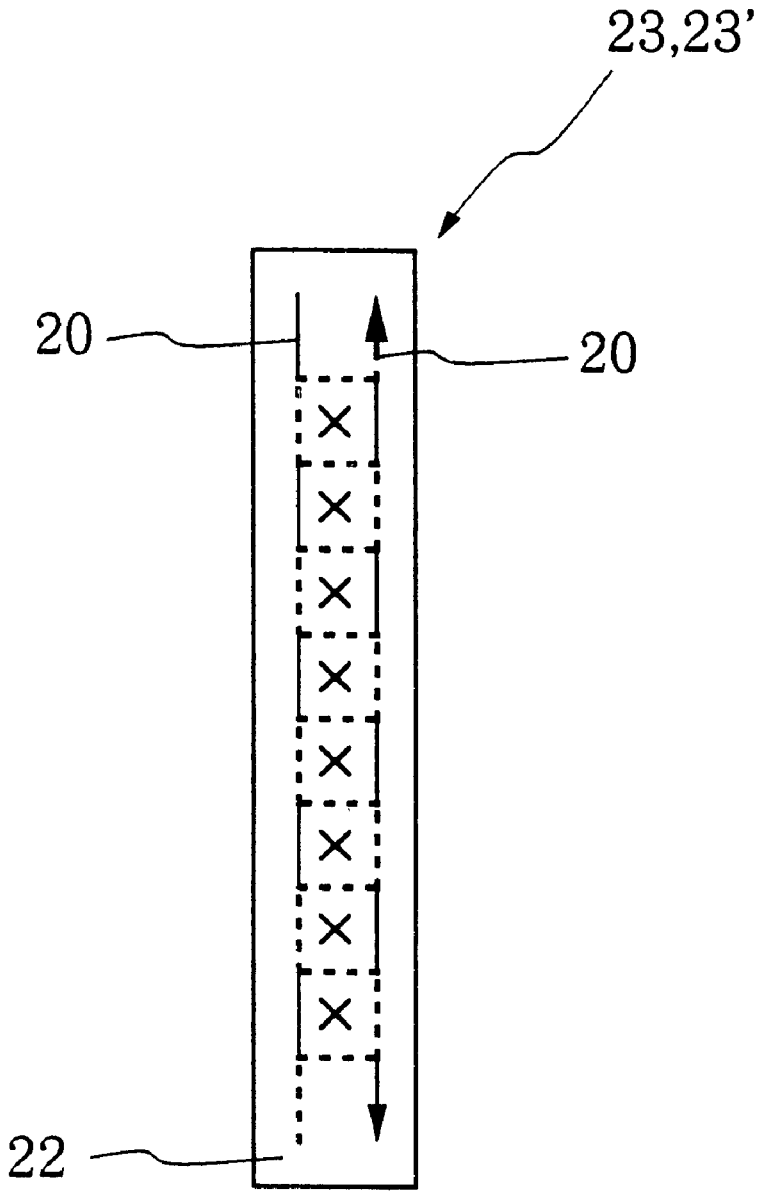
FIG. 4 is a front view of the linear vibrating device of FIG. 3 in an assembled state.
Figure 5:
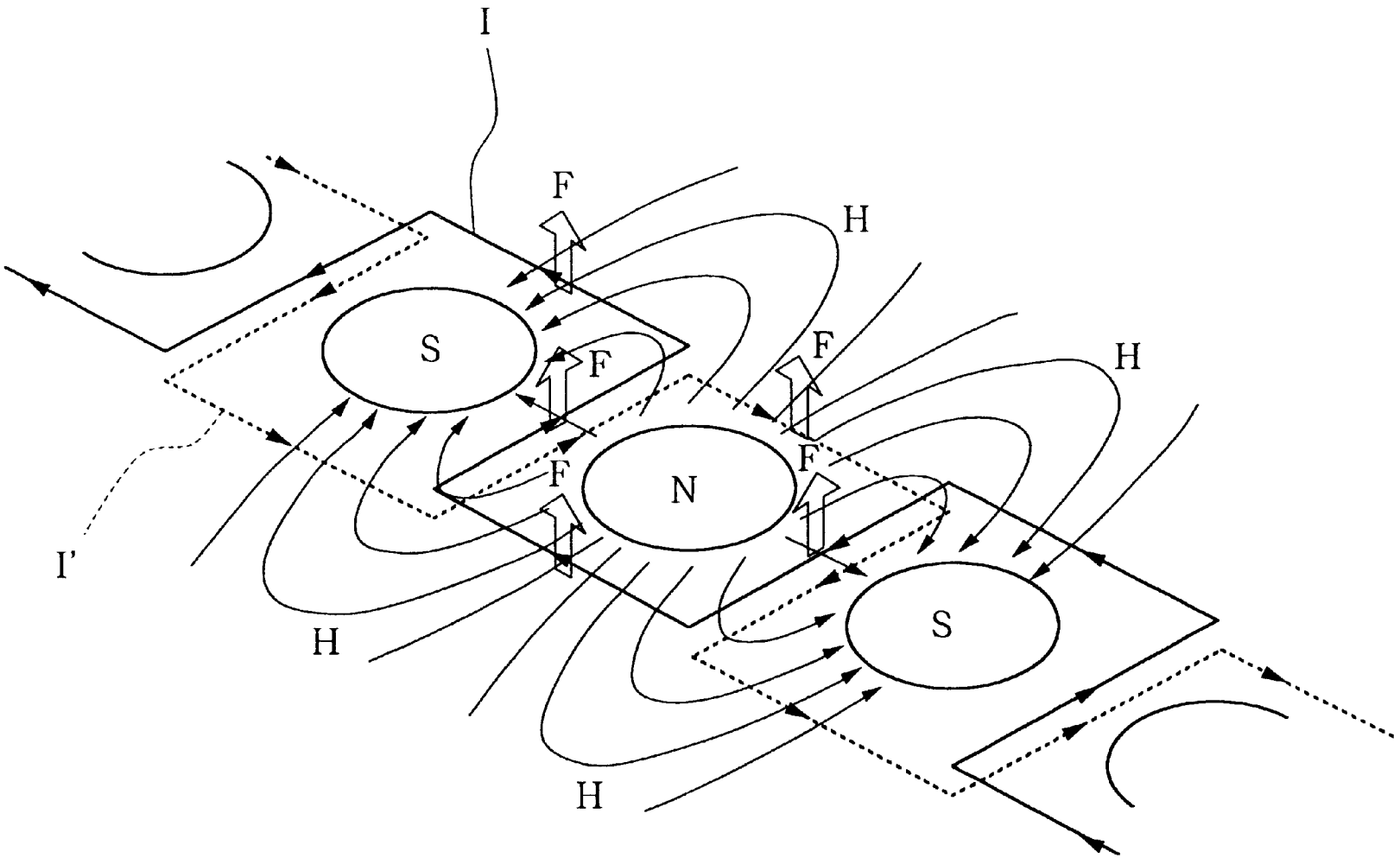
FIG. 5 is a perspective view of the linear vibrating device of FIG. 4, which is explanatory of operation of the vibrating device.

FIG. 4 shows the vibrating device in an assembled state where the conductor elements 23 and 23' are placed in overlapping relation to each other such that the mountain and valley portions of the conductor line 20 in one of the conductor elements overlap the valley and mountain portions, respectively, of the conductor line 20 in the other conductor element. In this state, each of the mountain portions of the conductor line 20 in one of the conductor element and the corresponding volley portion of the conductor line 20 in the other conductor element together constitute a rectangular conductor line portion where one of the magnets 21 is positioned. As electric currents are caused to flow through the two conductor lines 20 in opposite directions as indicated by arrows, the electric currents coact with the magnetic fields of the individual magnets 21 to produce electromagnetic force, as schematically shown in FIG. 5. Namely, the flowing direction of the current I through one of the conductor lines 20 and that of the current I' through the other conductor line 20 coincide with each other in regions where the above-mentioned rectangular conductor line portions of the two lines 20 overlap with each other. Each of the sides of the rectangular conductor line portions is traversed by magnetic lines of force flowing from the N poles to the S poles of the corresponding magnets 21, so that electromagnetic force F is produced, by coaction of the electric currents and magnetic lines of force, in a direction determined by the Fleming's left-hand rule. Although upward electromagnetic force F is produced with the electric currents flowing in the illustrated directions, downward electromagnetic force F is produced if the directions of the electric currents are reversed. As a consequence, the electromagnetic force varies in response to variations in electric current values of sound signals supplied to the conductor lines 20, which thereby produces force to drive or vibrate the diaphragm.

Figure 6:
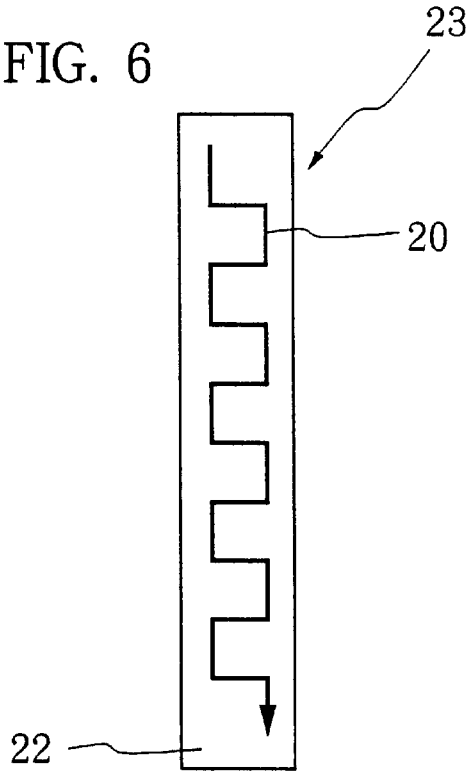
FIG. 6 is a front view showing another embodiment of the linear vibrating device.

Whereas FIGS. 4 and 5 shows the linear vibrating device where two conductor elements 23 and 23' are placed in overlapping relation, the number of the overlapping conductor elements may be increased as necessary to yield greater diaphragm-driving force. From a viewpoint of electromagnetic-force producing efficiency, it is desirable that the conductor elements are oriented in opposite directions, as in the illustrated example of FIG. 4, so that the mountain and valley portions of one of the conductor elements overlap with the valley and mountain portions of the other conductor element, as in the illustrated example of FIG. 5; however, the conductor elements may be oriented in the same direction so that the mountain and valley portions of one of the conductor elements overlap with the mountain and valley portions of the other conductor element. Further, as illustrated in FIG. 6, a single conductor element may include a plurality of conductor lines electrically insulated from each other, with a view to effectively increasing the electromagnetic force produced by the conductor element. As long as sufficient electromagnetic force can be produced, only one conductor element may be used in the inventive linear vibrating device.

In the illustrated examples, each of the conductor lines 20 is fixed relative to the diaphragm 1 by being fastened to the substrate 22 secured to the diaphragm 1 such as by adhesion. In an alternative, however, each of the conductor lines 20 may be fixed directly to the diaphragm 1 with no substrate 22 used. The conductor line 20 may comprise a metal line, such as a copper line, which is secured to the substrate 22 or diaphragm 1 by adhesion, or may comprise a conductive material formed on the substrate 22 or diaphragm 1 by plating, printing or the like.

Figure 7A:
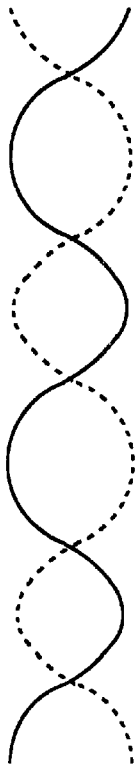
FIGS. 7A and 7B are diagrams showing examples of wave-shaped meandering conductor lines employed in the linear vibrating device.
Figure 7B:
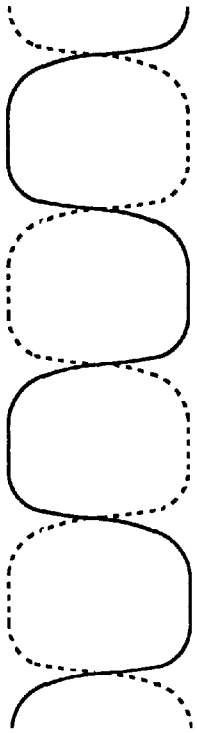

Whereas each of the conductor lines 20 has been shown and described as meandering in a rectangular wave shape, the present invention is not so limited; the conductor lines 20 may meander in any of various other suitable shape, such as a sine wave shape as shown in FIG. 7A and a near-circular curved wave shape.

Further, various other arrangements may be employed in the present invention, in order to enhance the electromagnetic-force producing efficiency, as will be described in detail below with reference to FIGS. 8 to 14.

Figure 8:
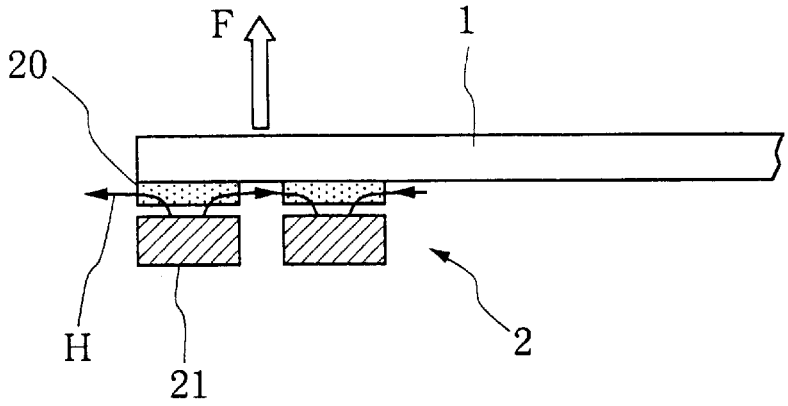
FIG. 8 is a cross-sectional view showing part of a speaker in accordance with another embodiment of the present invention.

FIG. 8 is a cross-sectional view showing an embodiment of the present invention where two linear vibrating devices 2 are disposed on and along one side edge portion of the diaphragm 1 in adjoining and parallel relation to each other. In this embodiment, the adjoining vibrating devices 2 are arranged so that the magnetic poles of the magnets 21 in one of the vibrating devices 2 exhibit opposite polarities to the magnetic poles of the magnets 21 in the other or opposed vibrating device 2. This arrangement allows magnetic fields to be produced in succession between the two vibrating devices, thereby enhancing action of the magnetic fields on the conductor line 20.

Figure 9:
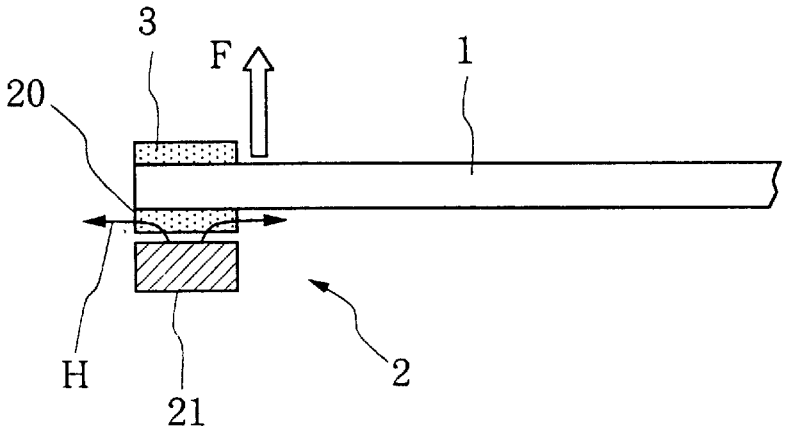
FIG. 9 is a cross-sectional view showing part of a speaker in accordance with still another embodiment of the present invention.

FIG. 9 shows still another embodiment where an auxiliary conductor line 3 is disposed on another surface of the diaphragm 1, opposite from the linear vibrating device 2, at a position corresponding to the vibrating device 2. The auxiliary conductor line 3 also meanders, in a wave-like shape, along the surface of the diaphragm 1, so as to form magnetic poles of same polarities as the magnetic poles of the conductor line 20 of the vibrating device 2. With this arrangement, high electric current density can be obtained in both the conductor lines of the linear vibrating device 2 and the auxiliary conductor line 3.

Figure 10:
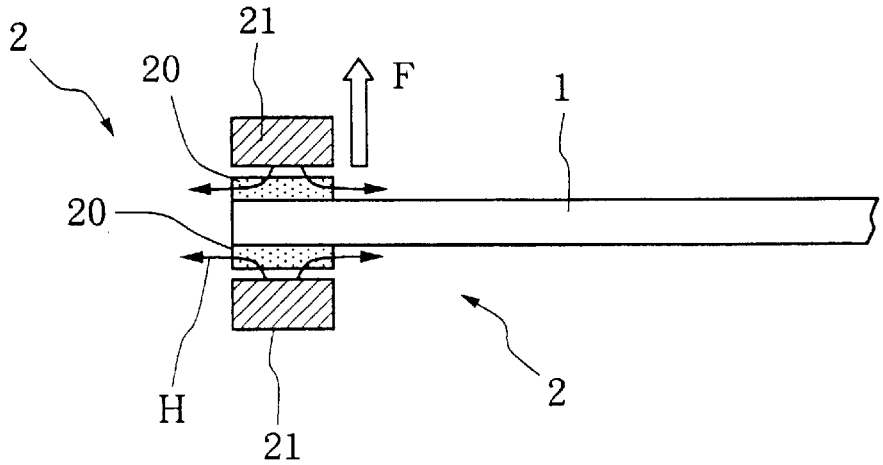
FIG. 10 is a cross-sectional view showing part of a speaker in accordance with still another embodiment of the present invention.

FIG. 10 shows still another embodiment where two linear vibrating devices 2 are disposed at corresponding positions on the opposite surfaces of the diaphragm 1. This arrangement can produce great diaphragm-vibrating force by energizing the two linear vibrating devices 2 in the same phase. Further, by arranging the two linear vibrating devices 2 so that magnetic poles of opposite polarities are opposed to each other between their respective magnets 21, magnetic flux in parallel magnetic fields can be effectively trimmed and also density of the magnetic flux can be increased.

Figure 11:
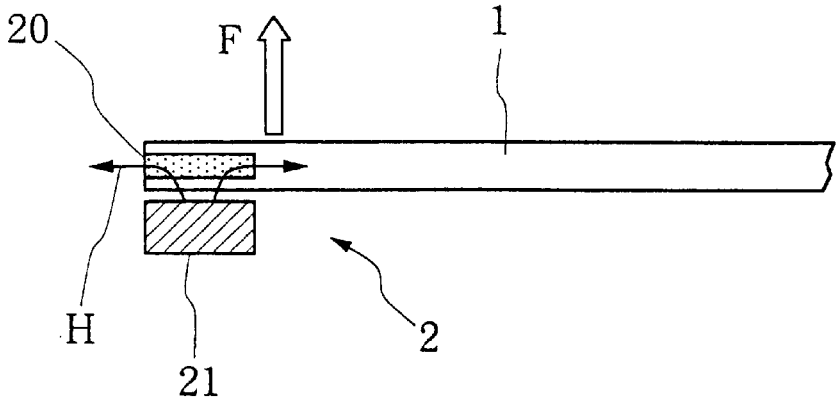
FIG. 11 is a cross-sectional view showing part of a speaker in accordance with still another embodiment of the present invention.

FIG. 11 shows still another embodiment where the conductor line 20 of the linear vibrating device 2 is embedded in a side edge portion of the diaphragm 1. Embedding the conductor line 20 like this can reduce a distance between the conductor line 20 and the magnets 21, so that the magnetic lines of force acting on the conductor line 20 can have increased density.

Figure 12:
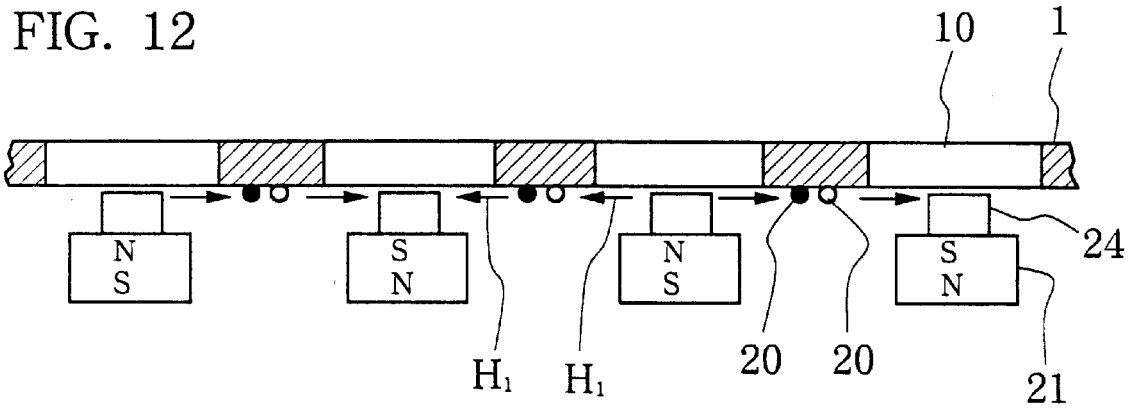
FIG. 12 is a cross-sectional view showing part of a speaker in accordance with still another embodiment of the present invention.

FIG. 12 is a sectional side view of the diaphragm 1 and the linear vibrating device 2. In this illustrated example, holes 10 are formed in the diaphragm 1 between adjoining mountain portions and between adjoining valley portions of each of the conductor lines 20. By making the holes 10 through-holes and positioning the magnets 21 to face the individual through-holes 10, the magnetic fields of the individual magnets 21 can be produced without being interfered by the diaphragm 1, and thus the magnetic field density can be increased. The provision of the holes 10 also achieves an enhanced heat radiation effect. The magnetic field density can also be increased by inserting a substance of high permeability in each of the holes 10.

More specifically, in the illustrated example of FIG. 12, each of the magnets 21 is coupled with a yoke 24 in the form of an iron piece that has a distal end located proximate to the corresponding hole 10. Although only two conductor lines 20 are shown for convenience of illustration, any other number of the conductor lines 20 may be provided. Each of the yokes 24 directs magnetic lines of force, leaving and entering the corresponding magnet 21, to its distal end. Because of the holes 10 thus formed in the diaphragm 1, the yokes 24 can be positioned in proximity to the diaphragm 1 without possibility of the yokes 24 contacting the diaphragm 1. With this arrangement, strongest possible magnetic lines of force $H_0$ can act on the conductor lines 20 in a direction linearly interconnecting the respective distal ends of the yokes 24 coupled with the magnets 21. As a consequence, it is possible to produce electromagnetic force in the conductor lines 20 with increased efficiency. In an alternative, the distal end of each of the yokes 24 may be positioned within the hole 10. In another alternative, the yokes 24 may be dispensed with, and the distal end of each of the magnets 21 may be positioned within or in proximity to the corresponding hole 10.

Figure 13:
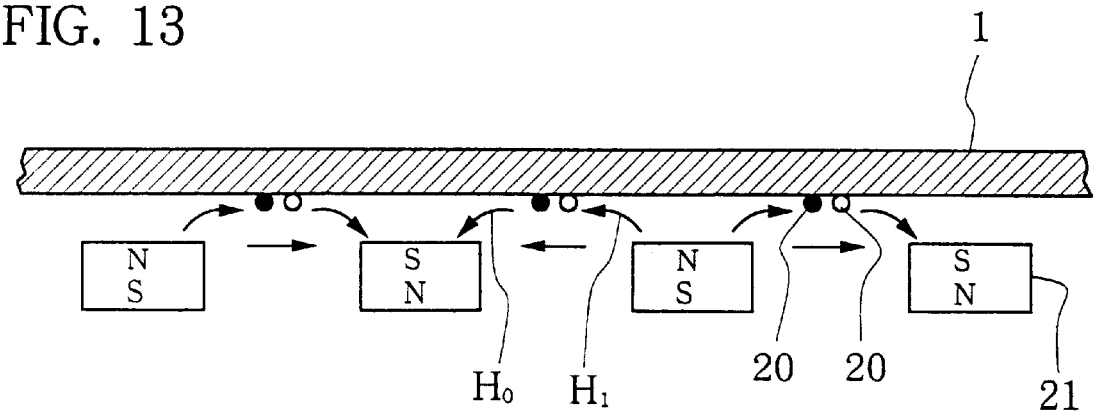
FIG. 13 is a cross-sectional view of showing part of a speaker in accordance with still another embodiment of the present invention, which is also explanatory of action of magnetic fields.

FIG. 13 shows still another embodiment which is generally similar to the embodiment of FIG. 12 but different therefrom primarily in that the above-mentioned holes 10 are not formed in the diaphragm 1. In this case, the magnets 21 are positioned at some distance from the diaphragm 1. As a result, the strongest possible magnetic lines of force $H_0$, linearly interconnecting the respective distal ends of the adjoining magnets 21, deviate from the conductor lines 20; instead, magnetic lines of force $H_1$, slightly lower in intensity than the magnetic lines of force $H_0$, act on the conductor lines 20. As a consequence, the electromagnetic-force producing efficiency in this embodiment is lower than that attained in the embodiment of FIG. 12.

Figure 14:
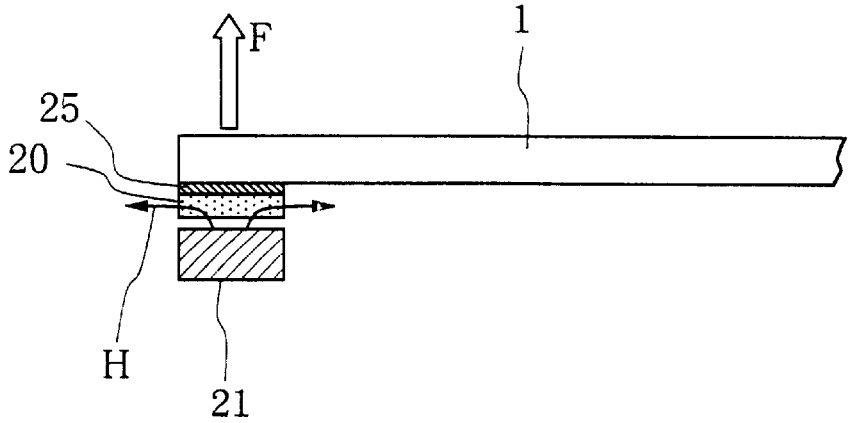
FIG. 14 is a cross-sectional view showing part of a speaker in accordance with still another embodiment of the present invention.
Figure 15:
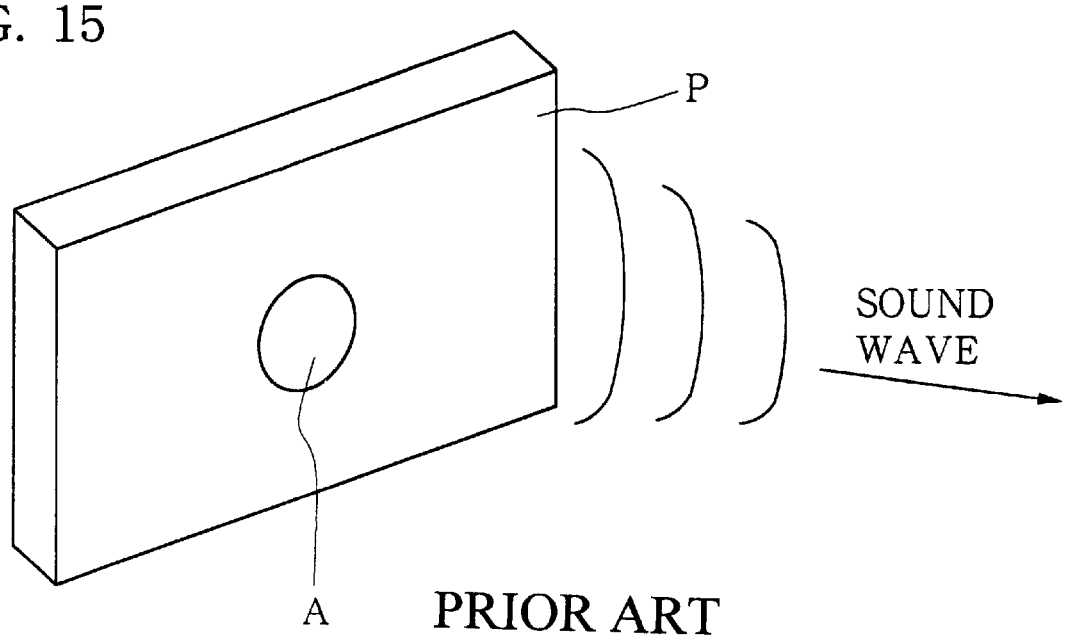
FIG. 15 is a perspective view showing an example of a conventional speaker.
Figure 16:
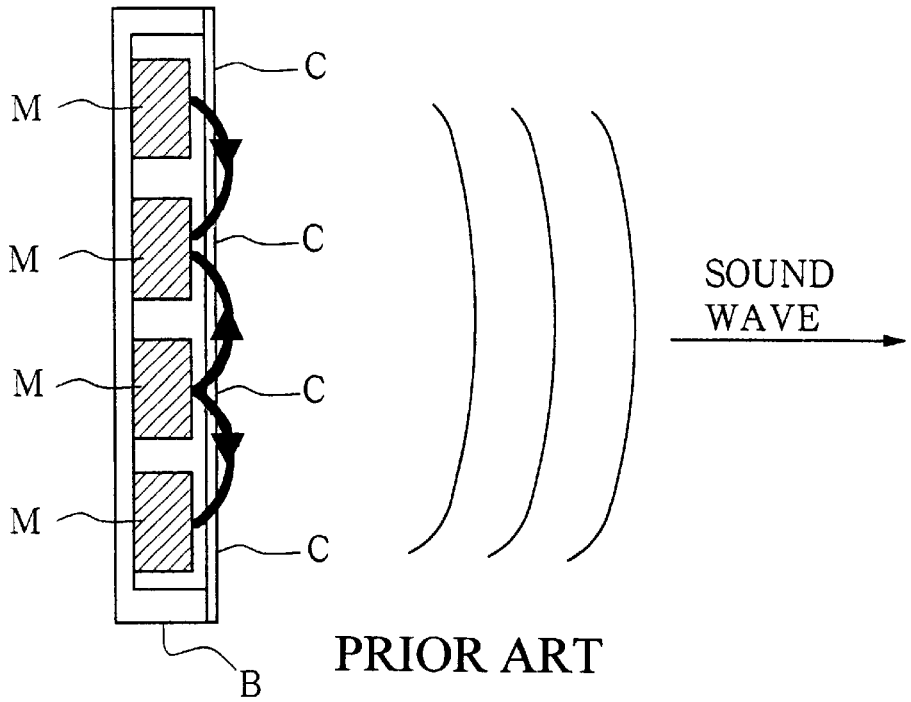
FIG. 16 is a cross-sectional view showing another example of a conventional speaker.
Figure 17:
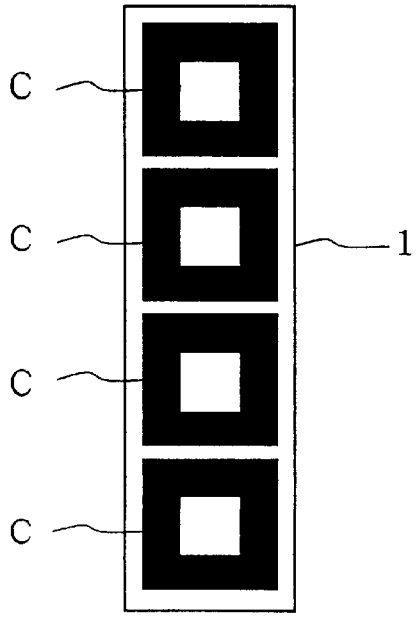
PRIOR ART FIG. 17
FIG. 17 is a front view of the speaker shown in FIG. 16.

In addition to the arrangements for enhancing the intensity of the diaphragm-driving force produced by the linear vibrating device, the present invention may employ arrangements for diversifying the form of driving the diaphragm as will be described below. FIG. 14 shows one of such embodiments where a piezoelectric vibrating device 25 is interposed between the conductor line 20 and the diaphragm 1 of the linear vibrating device 2. The piezoelectric vibrating device 25 includes a piezoelectric film, which is connected, via a not-shown lead, to a sound signal source (also not shown). By thus installing the additional driving section in overlapping relation to the linear vibrating device 2, the instant embodiment can provide a hybrid two-way driving system. Using such a hybrid two-way driving system, multiplex sound signals of music, human voice, etc. can be allotted to the respective driving sections to drive the same diaphragm. Further, if the driving signals are input to the driving sections with their frequency bands separated or not separated as appropriate, the signals can be sounded in the instant embodiment making the best use of respective acoustic characteristics of the linear vibrating device and the piezoelectric vibrating device 25.

Furthermore, the wave-shaved meandering conductor line of the inventive linear vibrating device may be provided in overlapping combination with multiplex coils provided along the diaphragm as employed in the conventional speaker that use printed coils and magnets. By such combination of the wave-shaved meandering conductor line of the inventive linear vibrating device and the printed coils of the conventional speaker, stacked wiring can be facilitated, and such stacked wiring can greatly increase the electric current density.

The above-described linear vibrating device of the present invention can be provided in any of various positions on the diaphragm as necessary. Namely, in place of or in addition to the linear vibrating devices provided on and vertically along the left and right side edge portions of the diaphragm 1 as shown in FIG. 1, one or more linear vibrating devices 2 may be provided on and horizontally along upper and/or lower end portions of the diaphragm 1 as denoted by dotted lines in FIG. 1. Instead of only one linear vibrating device being provided on each selected side edge portion of the diaphragm 1, a plurality of the linear vibrating devices 2 may be provided in series as denoted by dotted lines in FIG. 1, in which case these vibrating devices 2 may be driven in the same phase or by signals of different phases.

If the diaphragm 1 is made of a transparent material such as glass or plastic as previously noted, pictures shown on a CRT, LCD or other display device can be clearly viewed through the diaphragm 1 even where the diaphragm 1 is positioned in front of the display device. Further, in the case where the linear vibrating devices 2 are provided on the left and right side edge portions and upper and lower end portions of the diaphragm 1, the sound image can be adjusted to any desired positions by controlling the driving of the vibrating devices 2 independently of each other. Therefore, the sound image can be localized at a position appropriately suiting each picture shown on the display screen.

In addition to the diaphragm 1 being made of a transparent material, the conductor lines can also be made of a transparent material such as a silicon-based material. Thus, the conductor lines can be installed in an increased area without interfering the displayed pictures.

In summary, the linear vibrating device of the present invention attached to a peripheral portion of the diaphragm is characterized by including a conductor line meandering along the diaphragm surface in a wave-like shape. With the wave-like shape, the present invention can readily implement an improved form of the conductor line which can be installed continuously and can produce sufficient diaphragm-driving force. Because a plurality of such conductor lines can be readily combined in overlapping relation to each other, the present invention can readily increase the electric current density and thus is extremely useful for producing high electromagnetic force at low cost. The linear vibrating device of the present invention is also characterized in that the magnets are disposed in regions surrounded by adjoining mountain portions and adjoining valley portions of the conductor line and are arranged in such a manner that every adjoining magnets have their magnetic poles of opposite polarities located close to the conductor line. Thus, the linear vibrating device can produce force to drive the diaphragm outwardly in response to an electric current flowing through the conductor line.

Furthermore, because the wave-shaped meandering conductor line extends along a peripheral portion of the speaker, the present invention can produce outputs proportional to the length of the conductor line. Hence, the linear vibrating device can produce sufficiently great outputs as a whole even where the electric current density and magnetic flux density per length are low. As a result, the present invention can provide a speaker of a significantly reduced thickness.

What is claimed is:

1. A speaker comprising:

a diaphragm; and a linear vibrating device attached to a peripheral portion of said diaphragm for vibrating said diaphragm, said linear vibrating device including a conductor line meandering, in a wave-like shape, along a first surface of said diaphragm, and a succession of magnets disposed in opposed relation to said conductor line, said magnets being disposed in regions surrounded by adjoining mountain portions and adjoining valley portions of said conductor line and being arranged in such a manner that respective magnetic poles of each adjoining pair of said magnets are located close to said conductor line and have opposite polarities.

2. A speaker as claimed in claim 1 wherein a plurality of said linear vibrating devices are disposed along the peripheral portion of said diaphragm.

3. A speaker as claimed in claim 1 which further comprises an auxiliary conductive line extending, in a wave-like shape, along a second surface of said diaphragm opposite to said linear vibrating device, said auxiliary conductive line corresponding in position to said conductor line of said linear vibrating device and being arranged to form magnetic poles of same polarities as the magnetic poles of said conductor line of said linear vibrating device.

4. A speaker as claimed in claim 1 which further comprises auxiliary magnets disposed on another surface of said diaphragm opposite to said linear vibrating device in such a manner that magnetic poles of said auxiliary magnets are opposed to the magnetic poles of said magnets of said linear vibrating device with said diaphragm interposed therebetween and have opposite polarities to the magnetic poles of the said magnets of said linear vibrating device.

5. A speaker as claimed in claim 1 wherein a pair of said linear vibrating devices are disposed on opposite surfaces of said diaphragm so as to be opposed to each other with said diaphragm interposed therebetween.

6. A speaker as claimed in claim 1 wherein said diaphragm has a plurality of holes formed in the regions surrounded by the adjoining mountain portions and adjoining valley portions of said conductor line, and wherein each of the holes is formed as a through-hole or has a substance of high permeability inserted therein.

7. A speaker as claimed in claim 1 wherein said diaphragm has a plurality of holes formed in the regions surrounded by the adjoining mountain portions and adjoining valley portions of said conductor line, and wherein the magnetic poles of said magnets are each positioned within or in proximity to one of the holes.

8. A speaker as claimed in claim 1 which further comprises a plurality of yokes each connected with one of said magnets, and wherein distal ends of said yokes are each positioned within or in proximity to one of the holes.

9. A speaker as claimed in claim 1 wherein said conductor line is provided on said diaphragm by plating or printing.

10. A speaker as claimed in claim 1 which further comprises a piezoelectric vibrating device attached to said diaphragm along with said linear vibrating device.

11. A linear vibrating device comprising:

a transparent conductor line meandering, in a wave-like shape, along a surface of a diaphragm;

a piezoelectric vibrating device attached to said diaphragm along with said linear vibrating device;

a succession of magnets disposed in opposed relation to said transparent conductor line, said magnets being disposed in regions surrounded by adjoining mountain portions and adjoining valley portions of said transparent conductor line and being arranged in such a manner that respective magnetic poles of each adjoining pair of said magnets are located close to said transparent conductor line and have opposite polarities.

12. A speaker comprising:

diaphragm means; and linear vibrating means attached to a peripheral portion of said diaphragm means for vibrating said diaphragm means, said linear vibrating means including a conductor line meandering, in a wave-like shape, along a first surface of said diaphragm means, and a succession of magnet means disposed in opposed relation to said conductor line, said magnet means being disposed in regions surrounded by adjoining mountain portions and adjoining valley portions of said conductor line and being arranged in such a manner that respective magnetic poles of each adjoining pair of said magnet means are located close to said conductor line and have opposite polarities.

13. A speaker as claimed in claim 12 wherein a plurality of said linear vibrating means are disposed along the peripheral portion of said diaphragm means.

14. A speaker as claimed in claim 12 which further comprises an auxiliary conductive line extending, in a wave-like shape, along a second surface of said diaphragm means opposite to said linear vibrating means, said auxiliary conductive line corresponding in position to said conductor line of said linear vibrating means and being arranged to form magnetic poles of same polarities as the magnetic poles of said conductor line of said linear vibrating means.

15. A speaker as claimed in claim 12 which further comprises auxiliary magnet means disposed on another surface of said diaphragm means opposite to said linear vibrating means in such a manner that magnetic poles of said auxiliary magnet means are opposed to the magnetic poles of said magnet means of said linear vibrating means with said diaphragm means interposed therebetween and have opposite polarities to the magnetic poles of the said magnet means of said linear vibrating means.

16. A speaker as claimed in claim 12 wherein a pair of said linear vibrating means are disposed on opposite surfaces of said diaphragm means so as to be opposed to each other with said diaphragm means interposed therebetween.

17. A speaker as claimed in claim 12 wherein said diaphragm means has a plurality of holes formed in the regions surrounded by the adjoining mountain portions and adjoining valley portions of said conductor line, and wherein each of the holes is formed as a through-hole or has a substance of high permeability inserted therein.

18. A speaker as claimed in claim 12 wherein said diaphragm means has a plurality of holes formed in the regions surrounded by the adjoining mountain portions and adjoining valley portions of said conductor line, and wherein the magnetic poles of said magnet means are each positioned within or in proximity to one of the holes.

19. A speaker as claimed in claim 12 which further comprises a plurality of yoke means each connected with one of said magnet means, and wherein distal ends of said yoke means are each positioned within or in proximity to one of the holes.

20. A speaker as claimed in claim 12 wherein said conductor line is provided on said diaphragm means by plating or printing.

21. A speaker as claimed in claim 12 which further comprises a piezoelectric vibrating means attached to said diaphragm means along with said linear vibrating means.

22. A linear vibrating device comprising:

a transparent conductor line meandering, in a wave-like shape, along a surface of diaphragm means;

a piezoelectric vibrating device attached to said diaphragm along with said linear vibrating device;

a succession of magnet means disposed in opposed relation to said transparent conductor line, said magnet means being disposed in regions surrounded by adjoining mountain portions and adjoining valley portions of said transparent conductor line and being arranged in such a manner that respective magnetic poles of each adjoining pair of said magnet means are located close to said transparent conductor line and have opposite polarities.

* * * * *